US006371816B1

(12) United States Patent
Fukui

(10) Patent No.: US 6,371,816 B1
(45) Date of Patent: Apr. 16, 2002

(54) ELECTRIC CONNECTOR AND A METHOD OF MAKING SAME

(75) Inventor: Kunihiko Fukui, Osaka (JP)

(73) Assignee: Japan Solderless Terminal Manufacturing Co., Ltd., Osaka (JP)

( * ) Notice: Subject to any disclaimer, the term of this patent is extended or adjusted under 35 U.S.C. 154(b) by 0 days.

(21) Appl. No.: 09/225,002

(22) Filed: Jan. 4, 1999

(30) Foreign Application Priority Data

Jan. 16, 1998 (JP) ..... 10-020354

(51) Int. Cl.[7] ..... H01R 33/00
(52) U.S. Cl. ..... 439/660
(58) Field of Search ..... 439/660, 736, 439/74

(56) References Cited

U.S. PATENT DOCUMENTS 3,106,435 A * 10/1963 Yopp ..... 439/525
3,193,793 A * 7/1965 Plunkett et al. ..... 439/660
5,772,474 A * 6/1998 Yagi et al. ..... 439/660
6,099,359 A * 8/2000 Yammuro ..... 439/736

* cited by examiner

*Primary Examiner*—Neil Abrams
*Assistant Examiner*—J. F. Duverne
(74) *Attorney, Agent, or Firm*—Antonelli, Terry, Stout & Kraus, LLP

(57) ABSTRACT

An electric connector enclosed with an insulating housing (2) and having a plurality of contacts (10) arranged in parallel rows and along internal surfaces **(3*a*) of the insulating housing. Each contact (10) has a contacting portion (11) exposed in the internal surface and a solderable lead end (12) extending outwardly through a bottom (4) of the housing. A bent anchoring portion (13) is formed as a part of each contact and continuing from an upper end of the contacting portion (11) and bent outwardly to reach an external surface (3*b*) of the insulating housing, so that the bent anchoring portion (13) is embedded in the housing (2)** so as to hold the contacts at regular intervals and protect the contact from deviating from the insulating housing.

4 Claims, 7 Drawing Sheets

(a)
(b)
(c)
(d)
(e)
10
11
12
13
13a
14
15
21
22
23
24
3
3a
3b
4

(a)
13
13a
15
11
21
25
22
12
23
14

(b)
13
13a
11
3
21
25
22
4
12
23
14

(c)
13
3
11
3a
4
12
14
15

(d)
13
13a
3b
3
11
3a
4
12
15
14

(e)
13
13a
3b
3
10
11
3a
4
12
14

ELECTRIC CONNECTOR AND A METHOD OF MAKING SAME

BACKGROUND OF THE INVENTION

1. Field of the Invention

The present invention relates to an electric connector of the circuit board-to-circuit board type on one hand and also relates to a method of making such an electric connector that comprises an insulating housing and two rows of contacts, wherein the respective rows of the contacts are disposed on and along opposite internal surfaces of the housing and at regular intervals.

2. Prior Art

Generally, each row of the contacts built in the prior art connectors of this type will have been united together with a tie ledge before finally treated to give such a finished connector. This is because those contacts are inserted in an injection mold and between an outer section and an inner section thereof, during the so-called insert molding process to form an insulating housing. Subsequently, the tie ledge will be severed from the contacts so that the latter thus becoming discrete from each other within the housing, thereby forming two parallel rows of those contacts arranged at a predetermined pitch along the internal opposite surfaces of said housing.

Those contacts included in each row are very narrow and made of a so thin metallic sheet that the pitch at which they are arranged may sometimes become out of order after having been set in between the outer and inner sections of a mold. Further, they are likely to become bent within the mold. The insulating housing made of a resin is not so sticky to the metal contacts that the latter are protected well from exfoliation apart from and inclination away from the housing's internal surfaces.

The Japanese Patent Laying-Open Gazette No. 8-31486 discloses one of prior proposals directed to resolution of the described problems. According to this proposal, an upper free end of each contact tapers to engage with a tapered portion that is formed in the outer or inner section of a mold for forming an insulating housing. Such a prior art connector and a method of making it seem effective to avoid any irregularity in the pitch at which the contacts are arranged.

The prior art shown in the Gazette No. 8-31486 could however not contribute to resolve the second problem that the upper portions of the contacts tend to be slanted away from the internal surfaces of the insulating housing.

SUMMARY OF THE INVENTION

Therefore, an object of the present invention is to provide an electric connector and a method of making same such that each contact will be secured firmly in the connector at a precise pitch and without any fear of exfoliation from the internal surfaces of its insulating housing.

In order to achieve this object, the present inventor has employed a novel technological feature as summarized below. In this invention, a preamble structure is such that a plurality of contacts are arranged in parallel rows and at a given pitch along internal surfaces of an insulating housing, and each contact has a contacting portion and a solderable lead end, wherein the contacting portion is exposed in the internal surface and the lead end extends outwardly through a bottom of the insulating housing. The characterizing feature of the present connector is that each contact comprises a bent anchoring portion continuing from an upper end of the contacting portion and bent outwardly to reach an external surface of the insulating housing, wherein the bent anchoring portion is embedded in said housing.

Preferably, the bent anchoring portion of each contact may be hook-shaped. The contacting portion of each contact may not be disposed in flush with the internal surface but may protrude therefrom to render the connector more reliable in electrical connection.

A method proposed herein is designed to manufacture electric connectors each having a plurality of contacts that are arranged in parallel rows and at a given pitch along internal surfaces of an insulating housing, with each contact having a contacting portion and a solderable lead end, the method comprising the steps of preparing a mold for forming the insulating housing and consisting of an outer section and an inner section, with the inner section having curved recesses, further preparing a contact assembly that has a tie ledge uniting together the contacts each having a bent anchoring portion continuing from the conducting portion, subsequently placing the contact assembly in between the outer and inner sections of the mold in such a state that the respective bent anchoring portions fit in part in the respective curved recesses, and finally injection molding the insulating housing so that the contacting portions are exposed in the internal surfaces and the solderable lead ends extend outwardly through a bottom of the insulating housing, whereby the bent anchoring portions are embedded in said housing.

The inner section of the mold may have grooves formed therein to fit on the contacting portions of the contacts so that the contacts are more surely held in position at the predetermined pitch during the injection molding, and the contacting portion of each contact is not disposed in flush with the internal surface but protrudes therefrom after the insulating housing has been molded. Each groove may be shaped straight and continue to the curved recess, and thus the word 'groove' is meant herein to include the latter. In this context, the contacting portions in the finished connector will be exposed in the internal surfaces and protrude inwardly therefrom over their full length and partially in the direction of their width, as if they form ridge-shaped protuberances.

THE PREFERRED EMBODIMENTS

Figure 1:
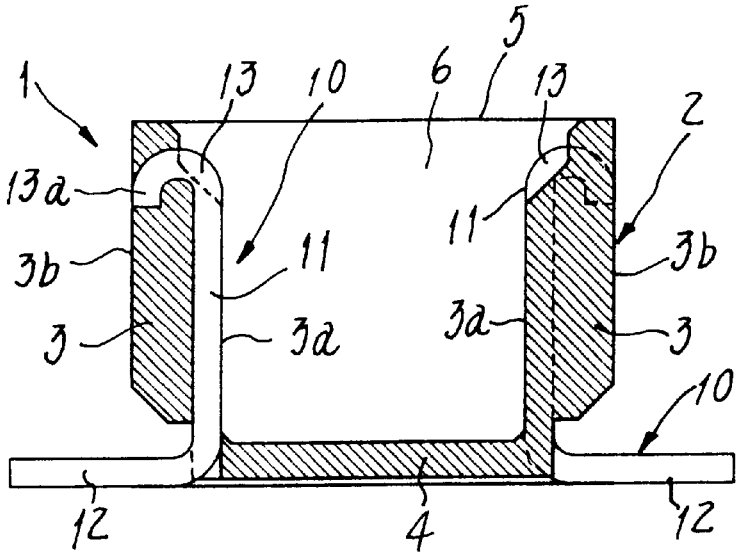
FIG. 1 is a vertical cross section of an electric connector provided in an embodiment of the present invention.

Now, some embodiments of the present invention will be described in detail referring to the drawings.

Figure 2:
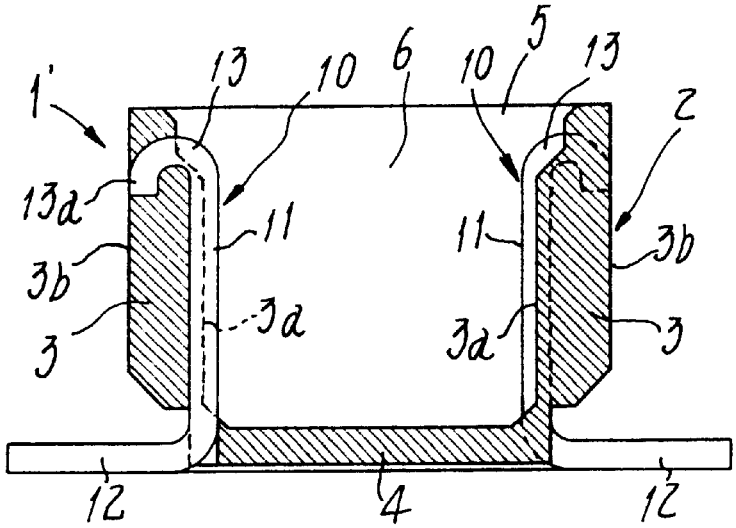
FIG. 2 is a cross section of the connector in accordance with another embodiment.

FIGS. 1 and 2 illustrate two examples of electric connectors 1 and 1' of the present invention. Those connectors are of the so-called 'board-to-board' type adapted for use to bring two printed circuit boards together into electric connection. Each connector 1 and 1' comprises an elongated and box-shaped insulating housing 2 that extends perpendicular to the drawing sheet and has opposite side walls 3 and 3 taking a right and left positions in the drawings. A plurality of contacts 10 of each connector are disposed along internal surfaces 3*a* and 3*a* of those side walls in two parallel rows and at a given pitch.

The housing 2 is molded with a synthetic resin, and the side walls 3 are connected to a bottom 4 and end walls 5 and 5 (only one of them being shown in the drawings), thus assuming a shape like a rectangular box and having an open top. A cavity 6 defined by and in such a box-shaped housing is intended to fit on a part of a (first) printed circuit board not shown so that the contacts 10 are electrically connected thereto.

Those contacts, which may be prepared by punching and then bending a thin and conductive metal sheet, have each a connecting portion 11, a solderable lead end 12 and a bent-anchoring portion 13. The contacting portion 11 takes a position in flush with the internal surface 3*a* of either sidewall 3 and exposed in part. The lead end 12 continues from the lower end of the contacting portion 11 and extends outwardly through the bottom 4 so as to be soldered to a conductive part in a mating (or second) printed circuit board not shown. The bent anchoring portion 13 continues from the upper end of the contacting portion 11 bent into a curved, hook-like shape. The anchoring portion 13 is embedded in either side wall 3 of the housing 2, as a result of the insert-molding thereof as further discussed below. A curved end 13*a* of each bent portion 13 terminates at the external surface of either side wall 3. In use, the part of the first-mentioned circuit board accommodated in the cavity 6 will thus come into electric contact with the contacting portions 11 of the contacts 10, thereby establishing electric connection to the second-mentioned circuit board.

The contacting portions 11 of the connector 1 shown in FIG. 1 have their exposed regions located in flush with the internal surface 3*a* of either side wall 3. However, the other connector 1' shown in FIG. 2 has the contacting portions 11 that are not only exposed in part but also protrude inwardly from said internal surfaces 3*a*. This arrangement is advantageous in that any flashes, which the insert molding process may possibly and undesirably produce, will not cause any failure in electric connection or any misconnection that would impair functional reliability of the connector.

Figure 3:
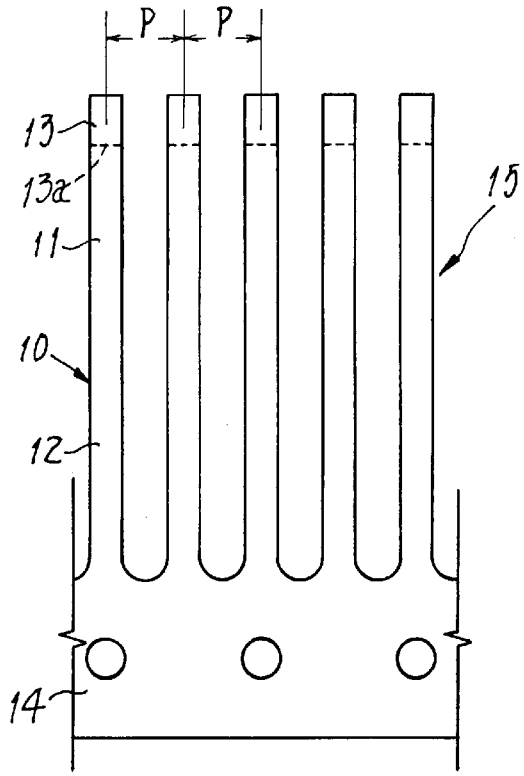
FIG. 3 is a front elevation of a contact assembly shown in part and adapted for use to manufacture the connector.
Figure 4:
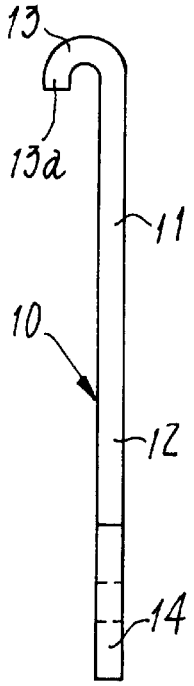
FIG. 4 is a side elevation of the contact assembly.
Figure 5:
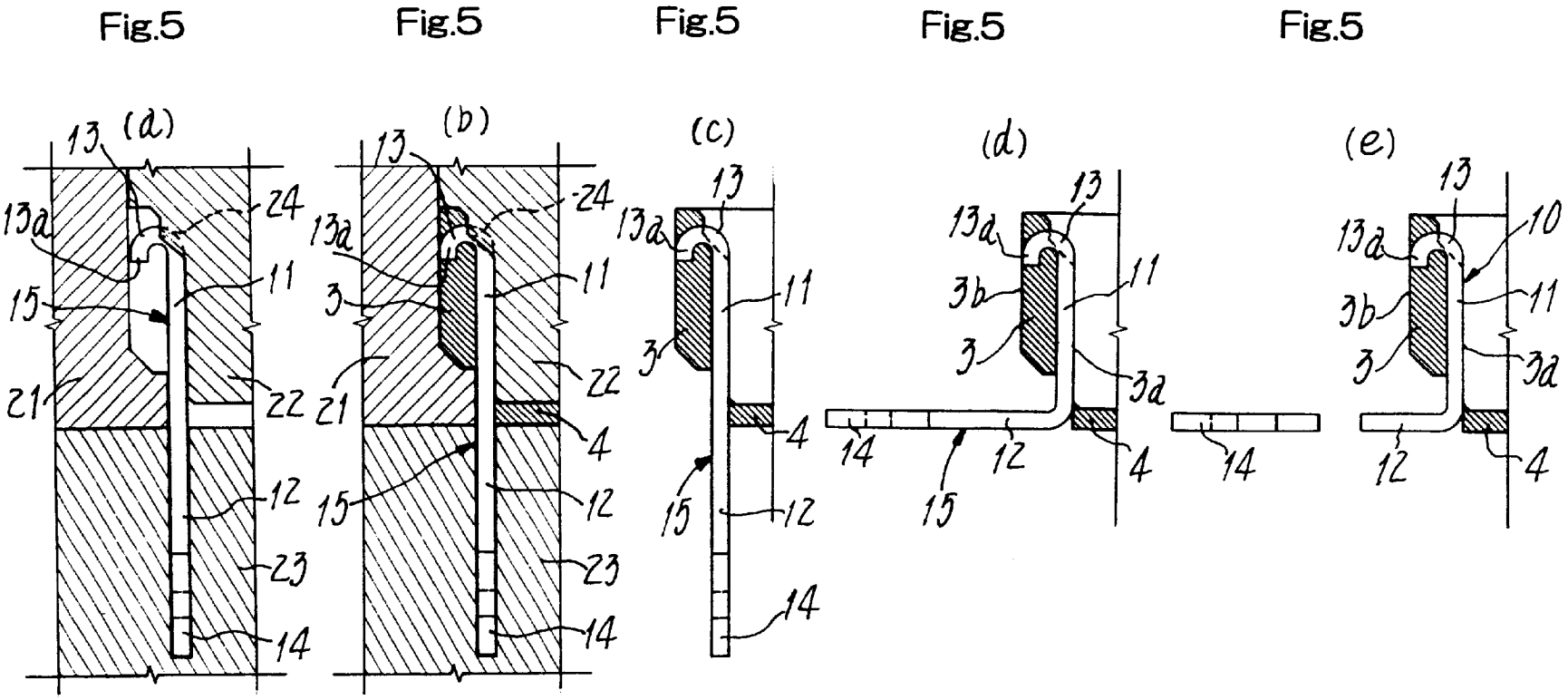
FIGS. 5*a* to 5*e* are vertical cross sections respectively showing the first to fifth stages in a process proposed herein to manufacture the electric connector.
Figure 6:
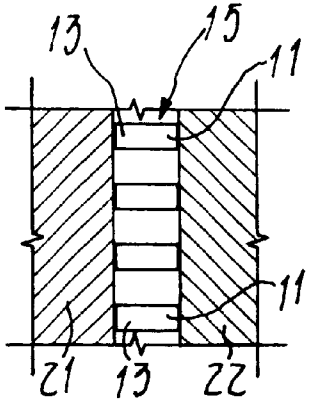
FIGS. 6*a* to 6*e* are horizontal cross sections corresponding to FIGS. 5*a* to 5*e*, respectively.
Figure 6:
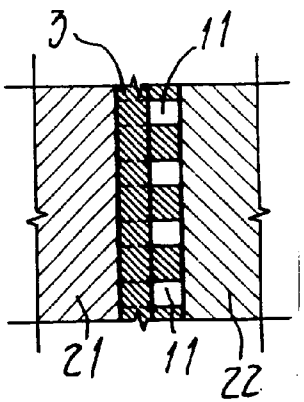
Figure 6:
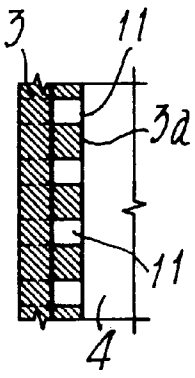
Figure 6:
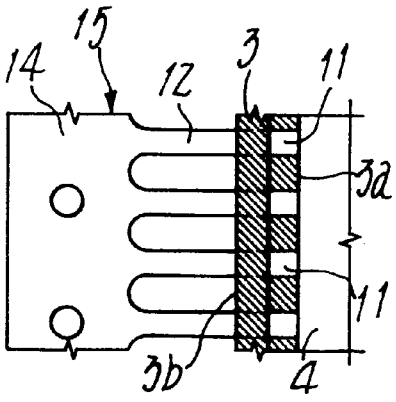
Figure 6:
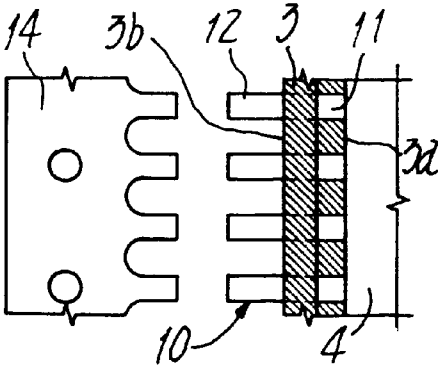
Figure 7:
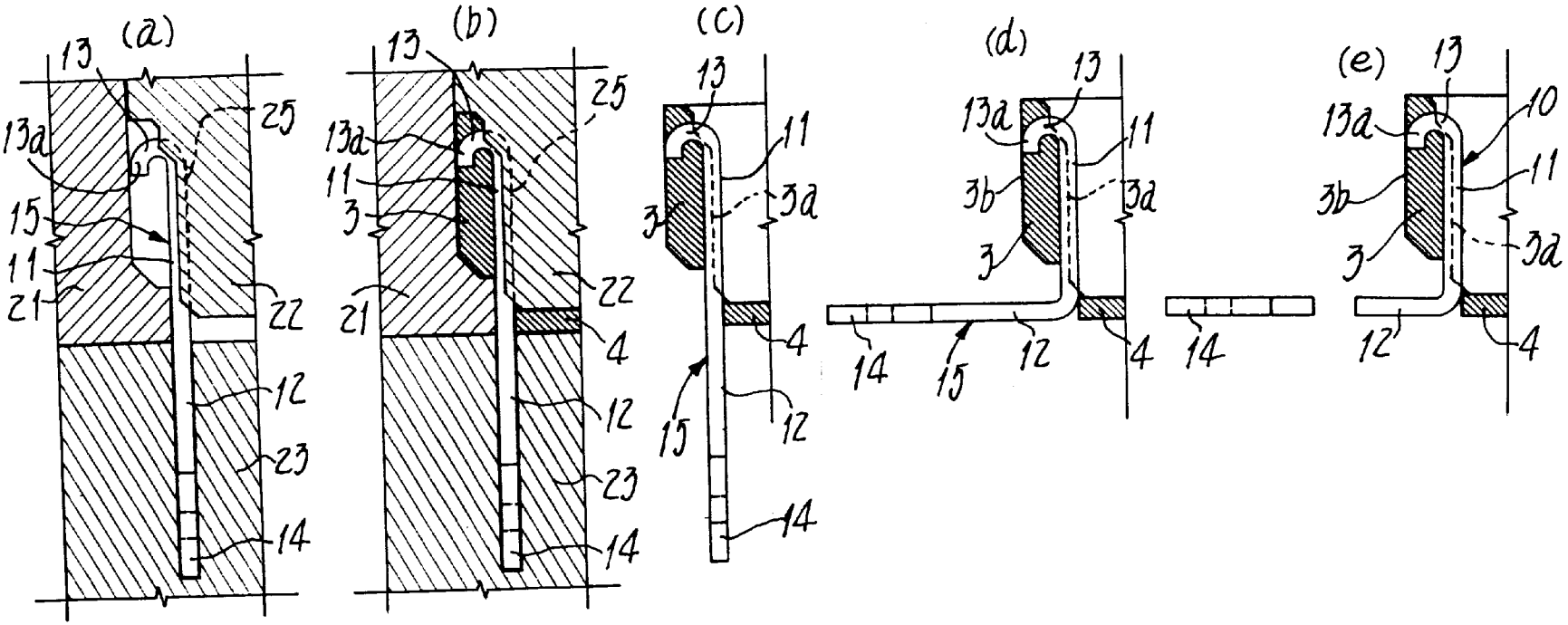
FIGS. 7*a* to 7*e* are vertical cross sections respectively showing the first to fifth stages in an alternative process also proposed herein to manufacture the electric connector.
Figure 8:
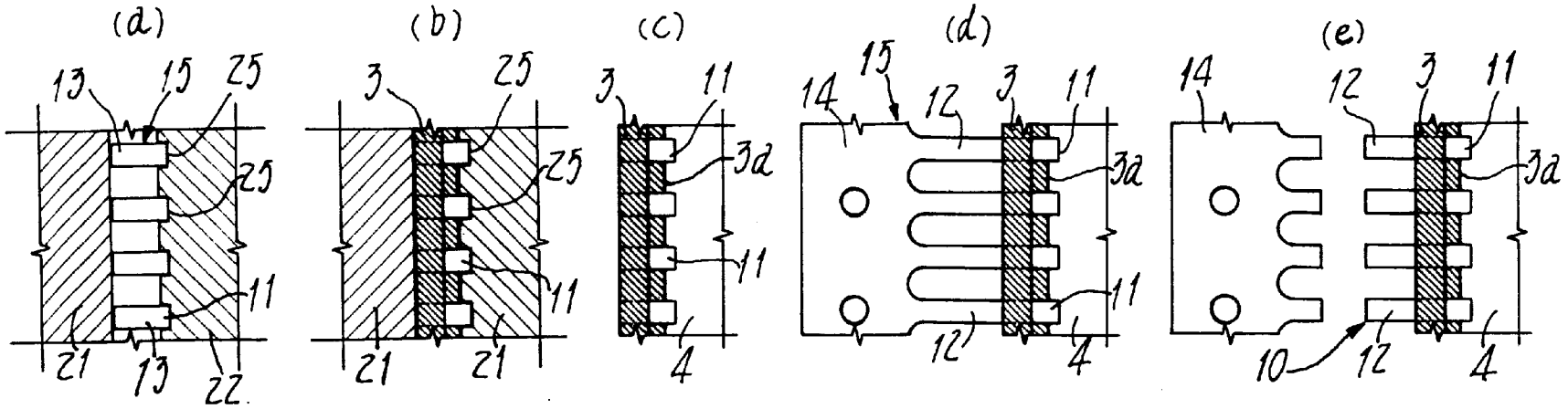
FIGS. 8*a* to 8*e* are horizontal cross sections corresponding to FIGS. 5*a* to 5*e*, respectively.

FIGS. 3 and 4 show a contact assembly 15 that will be prepared for use in the insert molding process, and this assembly consists of the contacts 10 whose contacting portions 11 and lead ends 12 lie straight and flat in a state just punched from a metal sheet. The upper ends of those contacting portions 11 will then be bent into a hook-shape to give the bent anchoring portions 13. The lower ends of the solderable lead ends 12 are united together by and formed integral with a tie ledge 14 such that said contacts are kept in a row at a predetermined accurate pitch 'P'. After having insert-molded the insulating housing, the lead ends 12 will be bent outwards generally at a right angle to the contacting portions, before severing the ledge 14 therefrom.

The method of making such an electric connector 1 or 1' as detailed above will now be described.

FIGS. 5*a* to 6*e* show a left-hand half of the connector 1 that is being manufactured. A mold consisting of an outer section 21, an inner section 22 and a base section 23 is designed such that the contacts 10 will be embedded in an insulating housing 2, which is formed in the mold by the insert-molding process. The inner section 22 has a plurality of curved recesses 24 arranged at a given pitch 'P'. When an assembly 15 of the contacts 10 is placed between the outer and inner sections 21 and 22, the contacts' bent anchoring portions 13 will be brought into engagement in part with the respective curved recesses 24 so that those contacts 10 take their exact positions at regular intervals.

As seen in FIGS. 5*a* and 6*a*, a tie ledge 14 uniting the contacts together to form the assembly 15 will temporarily be set in the base section 23, as the assembly is inserted in between the outer and inner sections of the mold as mentioned above. Outer ends 13*a* of the anchoring portions 13 all fitting in the recesses 24 are held in abutment with an internal surface of the outer mold section 21 while an amount of molten resin is injected into the mold to form an insulating housing 2. Thus, all the contacts' bent anchoring portions 13 will be embedded in a side wall 3 of the housing 2 (see FIG. 5*b*). Subsequent to injection molding, the mold sections will be separated from each other to leave an unfinished product shown in FIGS. 5*c* and 6*c*. In this unfinished product, the tie ledge 14 as well as the solderable lead ends 12 continuing therefrom extend straightly and downwards through a bottom 4 of the insulating housing 2 thus molded with the assembly 15 having acted as an 'insert'. Thereafter, the lead ends 12 will be bent generally at a right angle so as to extend in flush with the housing's bottom 4, in a manner shown in FIGS. 5*d* and 6*d*. Finally, the tie ledge 14 ill be severed off to give a finished electric connector 1 which FIGS. 5*e* and 6*e* illustrate in part.

FIGS. 7*a* to 8*e* show an alternative mode of the method modified to manufacture the modified connector 1' illustrated in FIG. 2. An inner section 22 of the mold used in this mode has channels or grooves 25 arranged at the pitch 'P' and substituting the curved recesses 24 in the mold for the first type of connector 1. Each groove 25 will receive not only a minor part of the bent anchoring portion 13 but also a major part of the contacting portion 11 of each contact 10. The other points of the mold and the method are all the same as those which have been discussed above for the first type connector 1, and details thereof will not be repeated here. In short, an end region of each bent anchoring portion 13 is embedded in the housing's side wall 3, with each exposed contacting portion 11 protruding from an inner surface of the side wall.

Figure 9:
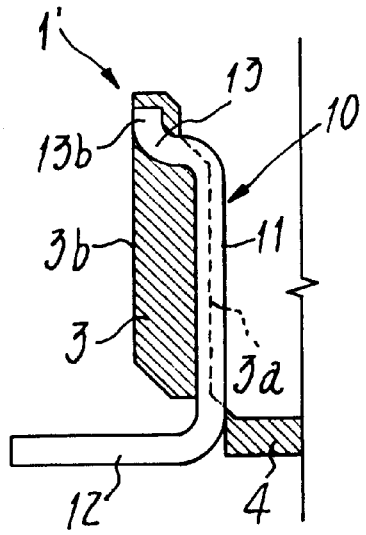
FIG. 9 is a cross section of the connector in accordance with a further embodiment.
Figure 10:
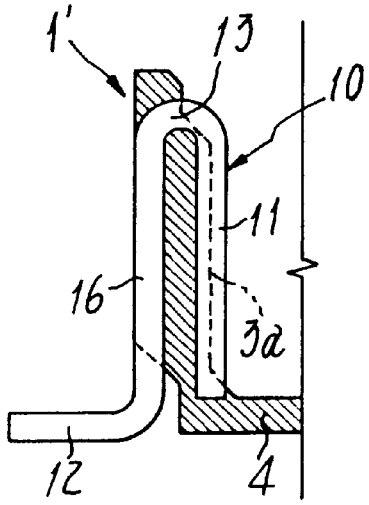
FIG. 10 is a cross section of the connector in accordance with a still further embodiment.

FIG. 9 shows a further embodiment wherein each contact of the connector 1' has a bent anchoring portion 13 of a modified shape. FIG. 10 shows a still further embodiment wherein an extension 16 from the anchoring portion 13 descends along an external surface of the insulating housing's sidewall 3. A free end region of such an extension 16 is bent outwards at a level in flush with the bottom 4 so as to provide the solderable lead end 12 not directly extending from the contacting portion.

In summary, during the insert molding of the connector's housing, each contact's contacting portion and each bent anchoring portion continuing therefrom, or the latter only, are kept in engagement with the mold inner section's recess or groove. By virtue of this feature in manufacture process, all the contacts in one connector will surely take their correct position at regular intervals and their bent anchoring portions embedded in the insulating housing's side walls will protect those contacts from the deviation from the internal surfaces of said housing.

What I claim is:

1. An electric connector enclosed with an insulating housing and having a plurality of contacts arranged in parallel rows and at regular intervals along internal surfaces of the insulating housing, wherein each contact has a contacting portion exposed in the internal surface and a solderable lead end extending outwardly through a bottom of the housing, comprising:

a hook-shaped bent anchoring portion formed as a part of each contact and continuing from an upper end of the contacting portion and bent outwardly to reach an external surface of the insulating housing, wherein the bent anchoring portion is embedded in said housing.

2. An electric connector enclosed with an insulating housing and having a plurality of contacts arranged in parallel rows and at regular intervals along internal surfaces of the insulating housing, wherein each contact has a contacting portion exposed in the internal surface and a solderable lead end extending outwardly through a bottom of the housing, comprising:

a bent anchoring portion formed as a part of each contact and continuing from an upper end of the contacting portion and bent outwardly to reach an external surface of the insulating housing, wherein the bent anchoring portion is embedded in said housing, wherein an extension from the bent anchoring portion extends down along an external surface of the insulating housing and then bent outwards at a region thereof adjacent to the bottom so as to provide the solderable lead end.

3. An electric connector as defined in claim 1 or 2, wherein the contacting portion of each contact protrudes in part inwardly from the internal surface.

4. An electric connector enclosed with an insulating housing and having a plurality of contacts arranged in parallel rows and at regular intervals along internal surfaces of the insulating housing, wherein each contact has a contacting portion exposed in the internal surface and a solderable lead end extending outwardly through a bottom of the housing, comprising:

a bent anchoring portion formed as a part of each contact and continuing from an upper end of the contacting portion and bent outwardly to reach an external surface of the insulating housing, wherein the bent anchoring portion is embedded in said housing, and wherein the contacting portion of each contact protrudes in part inwardly from the internal surface.

* * * * *